US010832607B2

(12) United States Patent
Huang

(10) Patent No.: US 10,832,607 B2
(45) Date of Patent: Nov. 10, 2020

(54) DISPLAY CONTROL DEVICE, DISPLAY, AND SELF-TEST INTERRUPT METHOD

(71) Applicant: HKC CORPORATION LIMITED, Guangdong (CN)

(72) Inventor: Beizhou Huang, Guangdong (CN)

(73) Assignee: HKC Corporation Limited, Guangdong (CN)

( * ) Notice: Subject to any disclaimer, the term of this patent is extended or adjusted under 35 U.S.C. 154(b) by 0 days.

(21) Appl. No.: 16/318,811

(22) PCT Filed: Oct. 22, 2018

(86) PCT No.: PCT/CN2018/111194
§ 371 (c)(1),
(2) Date: Jan. 18, 2019

(87) PCT Pub. No.: WO2020/062366
PCT Pub. Date: Apr. 2, 2020

(65) Prior Publication Data

US 2020/0105173 A1 Apr. 2, 2020

(30) Foreign Application Priority Data

Sep. 27, 2018 (CN) ..... 2018 1 1131862

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 3/3677* (2013.01); *G09G 2330/12* (2013.01)

(58) Field of Classification Search
CPC . G09G 3/3677; G09G 3/3648; G09G 2330/12
See application file for complete search history.

(56) References Cited

U.S. PATENT DOCUMENTS

| | | | | |
|---|---|---|---|---|
| 6,970,274 | B2 | 11/2005 | Morita et al. | |
| 8,665,201 | B2 | 3/2014 | Ueno | |
| 9,947,253 | B2 * | 4/2018 | Cho | G09G 3/006 |
| 9,955,150 | B2 * | 4/2018 | Gulati | G09G 3/006 |
| 2002/0075248 | A1 * | 6/2002 | Morita | G09G 3/3648 345/204 |

(Continued)

FOREIGN PATENT DOCUMENTS

| | | | |
|---|---|---|---|
| CN | 102144253 | A | 8/2011 |
| CN | 102843531 | A | 12/2012 |

(Continued)

OTHER PUBLICATIONS

Chinese Office Action for Application No. 2018111318622 dated Nov. 20, 2019, 8 pages.

(Continued)

*Primary Examiner* — Benyam Ketema
(74) *Attorney, Agent, or Firm* — Seyfarth Shaw LLP

(57) ABSTRACT

A display control device, a self-test interrupt module (30) of which controls operating states of a first driving circuit (10) and a second driving circuit (20) by detecting a feedback signal of the first driving circuit (10) and a feedback signal of the second driving circuit (20).

16 Claims, 6 Drawing Sheets

(56) References Cited

U.S. PATENT DOCUMENTS

| | | | | |
|---|---|---|---|---|
| 2008/0094531 | A1* | 4/2008 | Lee | G09G 3/3655 349/39 |
| 2008/0165110 | A1* | 7/2008 | Kim | G11C 19/28 345/99 |
| 2010/0201902 | A1* | 8/2010 | Hsu | G09G 3/3677 349/54 |
| 2011/0148825 | A1* | 6/2011 | Ueno | G09G 3/006 345/204 |
| 2015/0205563 | A1 | 7/2015 | Inada et al. | |
| 2015/0262528 | A1* | 9/2015 | Takahara | G09G 3/3258 345/212 |
| 2016/0247430 | A1* | 8/2016 | Cho | G09G 3/006 |
| 2017/0123556 | A1* | 5/2017 | Lin | G09G 3/20 |

FOREIGN PATENT DOCUMENTS

| | | | |
|---|---|---|---|
| CN | 104143309 | A | 11/2014 |
| CN | 104658467 | A | 5/2015 |
| CN | 105096876 | A | 11/2015 |
| CN | 106448595 | A | 2/2017 |
| CN | 107507593 | A | 12/2017 |
| TW | 228617 | B | 3/2005 |

OTHER PUBLICATIONS

International Search Report for Application No. PCT/CN2018/111194 dated Jul. 3, 2019, 10 pages.

* cited by examiner

DISPLAY CONTROL DEVICE, DISPLAY, AND SELF-TEST INTERRUPT METHOD

CROSS REFERENCE TO RELATED APPLICATIONS

This is a National Stage application of, and claims priority to PCT/CN2018/111194, filed Oct. 22, 2018, which claims priority to Chinese Patent Application No. 2018111318622, filed on Sep. 27, 2018, the disclosures of which are incorporated herein by reference in their entirety.

TECHNICAL FIELD

This application relates to a display control device, a display, and a self-test interrupt method.

BACKGROUND

Liquid crystal display (LCD) has many advantages such as thin body, power saving, and no radiation, and has been widely used, such as LCD television, mobile phone, Personal Digital Assistant (PDA), digital camera, computer screen, or laptop screen, etc., which plays a leading role in the field of flat panel display.

GDL (Gate Driver Less) technology, that is, an array substrate line driving technology, utilizes an conventional array process of a liquid crystal display panel to fabricate a horizontal scanning line driving circuit on a substrate around a display area, so that it can replace an external integrated circuit (IC) to complete the drive of the horizontal scan line. Driving the display panel via a driving circuit fabricated by GDL technology can reduce a welding process of the external IC, has an opportunity to improve production capacity and reduce product cost, and can make the display panel more suitable for the production of narrow border or borderless display products.

However, the inventors realize that there are thousands of TFT devices in the driving circuit (GDL circuit), and once the device has a poor uniformity or a poor stability, the driving circuit is abnormal, resulting in failure of the display panel and causing the display panel with a low reliability.

SUMMARY

According to various embodiments of the present disclosure, a display control device, a display, and a self-test interrupt method are provided.

A display control device includes a first driving circuit, a second driving circuit and a self-test interrupt module. The first driving circuit is used to drive a display panel from a first side. An output terminal of the first driving circuit is connected to a first input terminal of the self-test interrupt module. The second driving circuit is used to drive the display panel from a second side. An output terminal of the second driving circuit is connected to a second input terminal of the self-test interrupt module. A first output terminal of the self-test interrupt module is connected to an input terminal of the first driving circuit. A second output terminal of the self-test interrupt module is connected to an input terminal of the second driving circuit. A start signal terminal of the self-test interrupt module is used to access a vertical synchronization signal. The self-test interrupt module is used to disconnect an input path of the vertical synchronization signal to the first driving circuit when a signal fed back by the output terminal of the first driving circuit is abnormal or the self-test interrupt module is used to disconnect an input path of the vertical synchronization to the second driving circuit when a signal fed back by the output terminal of the second driving circuit is abnormal.

A display includes a display panel and the aforementioned display control device.

A self-test interrupt method applied to the aforementioned display control device includes:

acquiring a signal fed back by a first driving circuit and a signal fed back by a second driving circuit;

when detecting that the signal fed back by the first driving circuit is abnormal, disconnecting an input path of a vertical synchronization signal to the first driving circuit, or when detecting that the signal fed back by the second driving circuit is abnormal, disconnecting an input path of the vertical synchronization signal to the second driving circuit.

Details of one or more embodiments of the present application are set forth in the accompanying drawings and description below. Other features and advantages of the present disclosure will be apparent from the specification, drawings and claims.

BRIEF DESCRIPTION OF THE DRAWINGS

To illustrate the technical solutions according to the embodiments of the present disclosure more clearly, the accompanying drawings for describing the embodiments are introduced briefly in the following. Apparently, the accompanying drawings in the following description are merely some embodiments of the present invention, and persons of ordinary skill in the art can derive other drawings from the accompanying drawings without creative efforts.

DETAILED DESCRIPTION OF THE EMBODIMENTS

In order to make the technical solutions and advantages of the present application more clear, the present application will be further described in detail below with reference to the accompanying drawings and embodiments. It should be understood that the specific embodiments described herein are merely illustrative of the application and are not intended to limit the present application.

Figure 1:
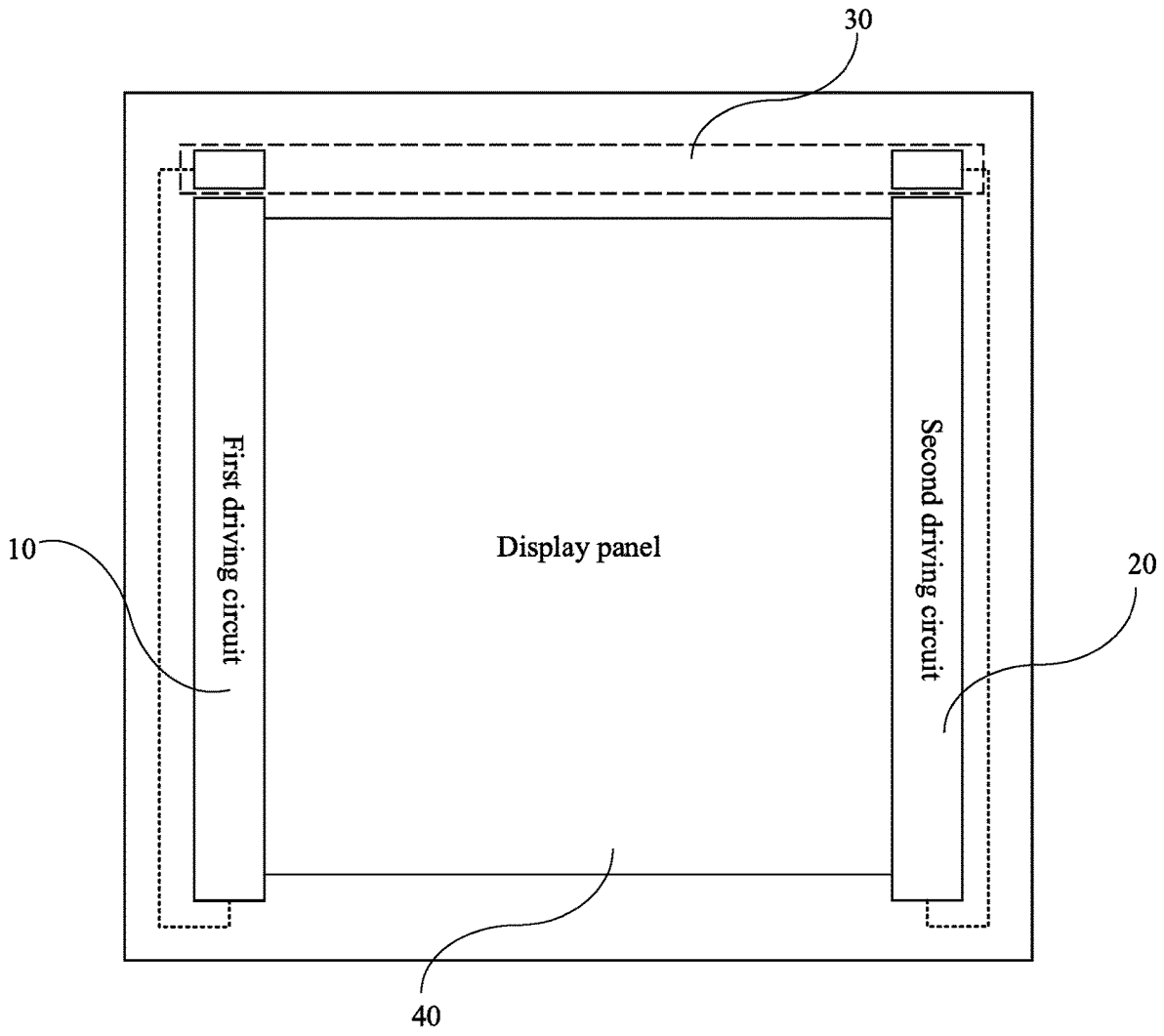
FIG. 1 is a schematic diagram of a display control device in accordance with one or more embodiments.

A display control device is provided according to an embodiment of the present disclosure. As shown in FIG. 1, the display control device includes a first driving circuit 10, a second driving circuit 20, and a self-test interrupt module 30. The first driving circuit 10 is used to drive a display panel 40 from a first side. An output terminal of the first driving circuit 10 is connected to a first input terminal of the self-test interrupt module 30. The second driving circuit 20 is used to drive the display panel 40 from a second side. An output terminal of the second driving circuit 20 is connected to a second input terminal of the self-test interrupt module 30. A first output terminal of the self-test interrupt module 30 is connected to an input terminal of the first driving circuit 10, and a second output terminal of the self-test interrupt module 30 is connected to an input terminal of the second driving circuit 20. A start signal terminal of the self-test interrupt module 30 is used to access a vertical synchronization signal. The self-test interrupt module 30 is used to disconnect an input path of the vertical synchronization signal to the first driving circuit 10 when a signal fed back by the output terminal of the first driving circuit 10 is abnormal, or disconnect an input path of the vertical synchronization signal to the second driving circuit 20 when a signal fed back by the output terminal of the second driving circuit 20 is abnormal.

The driving circuit can be a gate driver less driving circuit, which is simply referred to as a GDL circuit. The GDL circuit is a driving circuit of a horizontal scanning line, fabricated on a substrate surrounding a display area via a conventional array process of the display panel 40. The first side and the second side refer to a left side and a right side with respect to the display area of the display panel 40, when the display panel 40 is normally used. In other words, the first driving circuit 10 and the second driving circuit 20 respectively drive thin film transistors on the display panel 40 from the left and right sides of the display panel 40. The vertical synchronization signal (STV signal, also called frame synchronization signal) is a control signal output by a timing controller to indicate start of a new frame of image. The self-test interrupt module 30 refers to a circuit module capable of performing self-test on operations of the first driving circuit 10 and the second driving circuit 20 and controlling drive operation states of the first driving circuit 10 and the second driving circuit 20 according to self-test results.

The first input terminal of the self-test interrupt module 30 can receive an output electrical signal of the first driving circuit 10. At the same time, the second input terminal of the self-test interrupt module 30 can receive an output electrical signal of the second driving circuit 20. When the self-test interrupt module 30 detects that the output of the first driving circuit 10 is abnormal, in order to ensure that the display panel 40 can be normally driven, the first output terminal of the self-test interrupt module 30 outputs a control signal to disconnect the input path of the vertical synchronizing signal to the first driving circuit 10, so that the first driving circuit can be cut off and the second driving circuit 20 drives the display panel 40 to display from the second side. A bilateral drive mode is switched to a unilateral operation mode to ensure that the display panel 40 can be normally driven to display when one unilateral driving circuit is abnormal. Alternatively, when the self-test interrupt module 30 detects that the output of the second driving circuit 20 is abnormal, it indicates that the second driving circuit 20 may be faulty due to poor uniformity and stability of components of the second driving circuit 20, and the display panel 40 cannot be normally driven from the second side. At this time, the self-test interrupt module 30 disconnects the input path of the vertical synchronization signal to the second driving circuit 20, so that the second driving circuit 20 is cut off, and the bilateral drive mode of the first driving circuit 10 and the second driving circuit 20 is switched to a unilateral drive mode of the first driving circuit 10.

Figure 2:
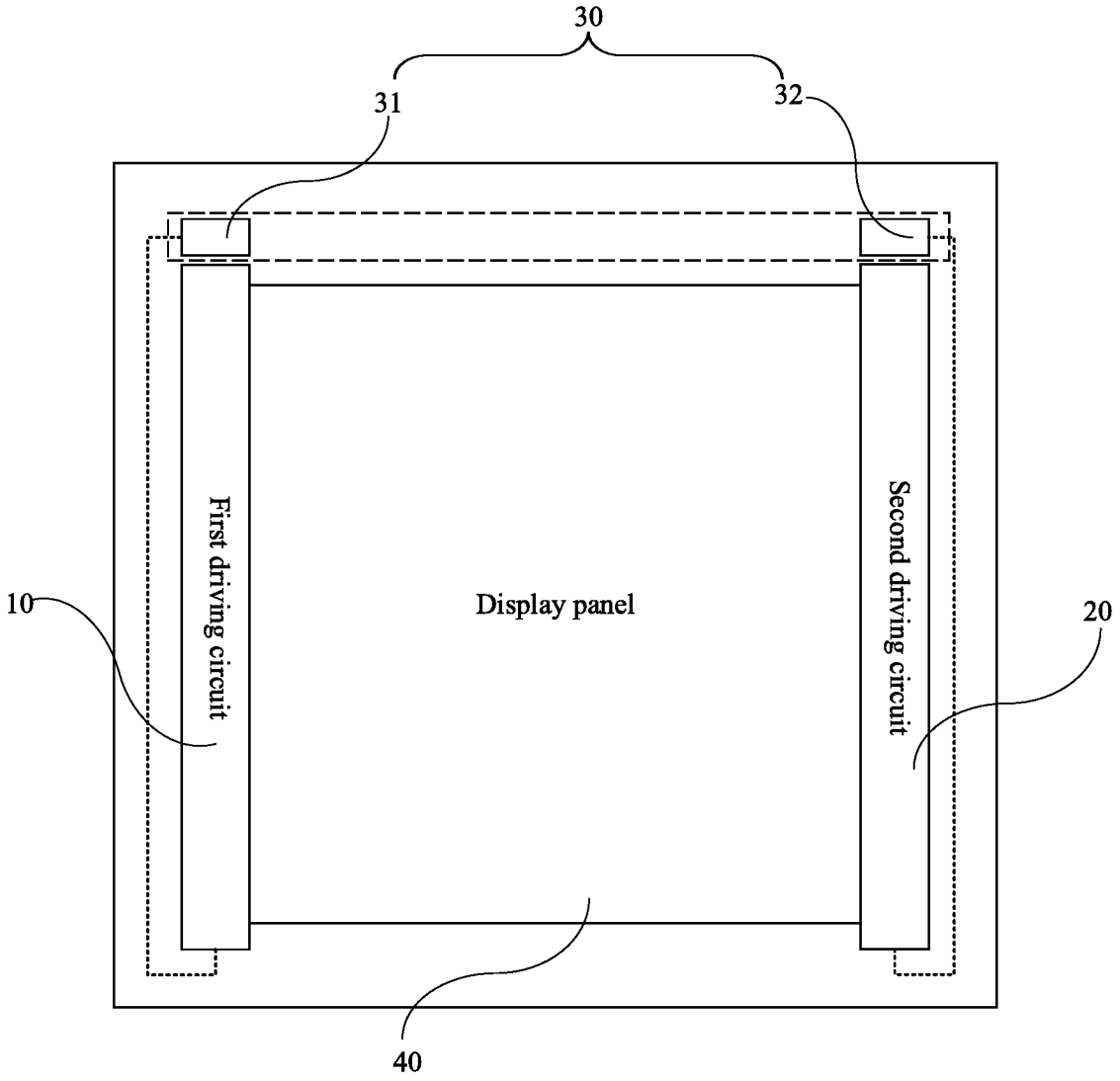
FIG. 2 is a schematic diagram of a display control device in accordance with an alternative embodiment.

In one of the embodiments, as shown in FIG. 2, the self-test interrupt module 30 includes a first self-test interrupt circuit 31 and a second self-test interrupt circuit 32. The first driving circuit 10 includes the input terminal and a multi-stage output terminal. The second driving circuit 20 includes the input terminal and a multi-stage output terminal. An input terminal of the first self-test interrupt circuit 31 is connected to a rear-stage output terminal of the first driving circuit 10, and an output terminal of the first self-test interrupt circuit 31 is connected to the first driving circuit 10. An input terminal of the second self-test interrupt circuit 32 is connected to a rear-stage output terminal of the second driving circuit 20, and an output terminal of the second self-test interrupt circuit 32 is connected to the second driving circuit 20.

The multi-stage output terminal refers to that input signals of the first driving circuit 10 and the second driving circuit 20 are transmitted stage by stage from the input terminal, and correspond to one output terminal at each stage. In order to detect an overall situation of the first driving circuit 10 and the second driving circuit 20 better, and achieve independent interrupt control of the first driving circuit 10 and the second driving circuit 20, the first self-test interrupt circuit 31 is used to detect a signal fed back by the rear-stage output terminal of the first driving circuit 10 and determine whether the output of the current first driving circuit 10 is abnormal. If yes, the first self-test interrupt circuit 31 cuts off a path of a STV signal to the first driving circuit 10, and the display panel 40 is driven to display by a unilateral drive of the second driving circuit 20. Similarly, the second self-test interrupt circuit 32 is used to detect a signal fed back by the rear-stage output terminal of the second driving circuit 20 and determine whether the output of the second driving circuit 20 is abnormal. If yes, the second self-test interrupt circuit 32 cuts off a path of the STV signal to the second driving circuit 20, and the display panel 40 is driven to display by a unilateral drive of the first driving circuit 10.

Figure 3:
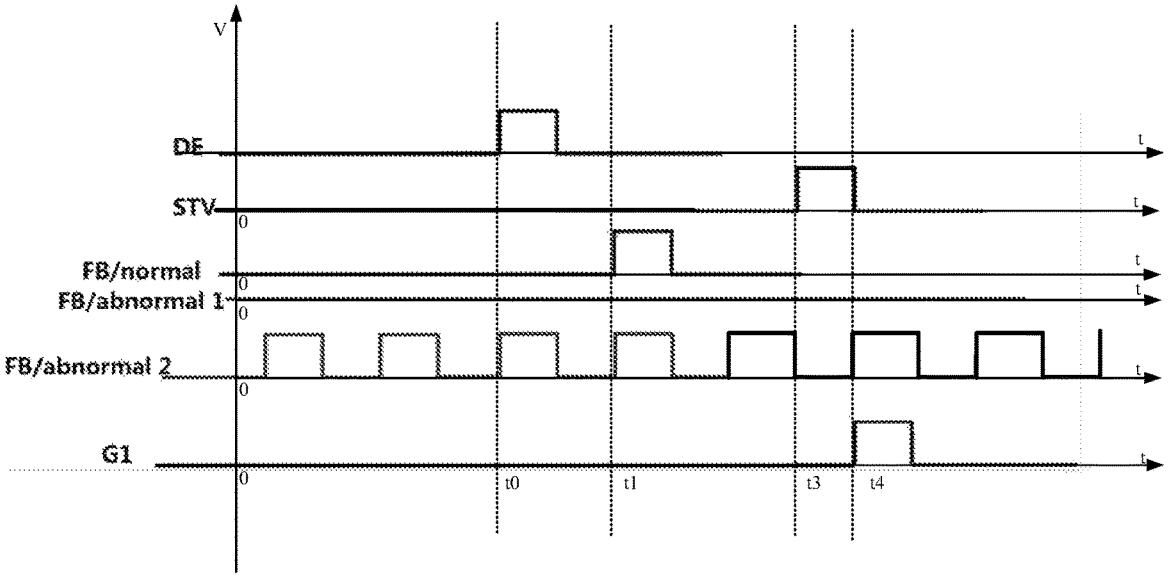
FIG. 3 is a timing diagram of a feedback signal of a first driving circuit in accordance with one or more embodiments.

In one of the embodiments, as shown in FIG. 3, the display panel 40 includes a positive power input terminal, a negative power input terminal, and a common electrode. The positive power input terminal is used to connect to a gate-on power source. The negative power input terminal is used to connect to a gate-off the power source. The common electrode is used to access a common voltage. The first self-test interrupt circuit 31 includes a first transistor T1, a second transistor T2, a third transistor T3, a fourth transistor T4, a fifth transistor T5, a sixth transistor T6, and a first capacitor C1. A first electrode of the first transistor T1 is used to connect the positive power input terminal. A control electrode of the first transistor T1 is connected to the output terminal of the first driving circuit 10. A second electrode of the first transistor T1 is connected to a first electrode of the second transistor T2. A control electrode of the second transistor T2 is used to access a data enable signal. A second electrode of the second transistor T2 is used to connect the common electrode and a control electrode of the fourth transistor T4. A first electrode of the third transistor T3 is used to connect the positive power input terminal. A control electrode of the third transistor T3 is connected to the output terminal of the first driving circuit 10. A second electrode of the third transistor T3 is respectively connected to a first electrode of the fourth transistor T4, a control electrode of the fifth transistor T5, and a first electrode of the sixth transistor T6. A second electrode of the fourth transistor T4 is used to connect to the negative power input terminal. A first electrode of the fifth transistor T5 is used to access the vertical synchronization signal. A second electrode of the five transistor T5 is connected to the input terminal of the first driving circuit 10. A control electrode of the sixth transistor T6 is used to access a scan signal. The scan signal is used to scan the display panel 40. A second electrode of the sixth transistor T6 is connected to the negative power input terminal. One end of the first capacitor C1 is connected to the control electrode of the fifth transistor T5, and the other end thereof is connected to the second electrode of the fifth transistor T5.

The gate-on power supply refers to a power supply provided for turning on a gate, which is a positive power supply VGH. The gate-off power supply refers to a power supply provided for turning off the gate, which is a negative power supply VHL. A positive voltage difference is generated between the gate-on power supply voltage VGH connected to the positive power input terminal of the display panel 40 and the common voltage, which turns on thin film transistors of the display panel 40 and thin film transistor connected to each liquid crystal. A negative voltage difference is generated between the gate-off power supply voltage VHL connected to the negative power input terminal and the common voltage, which is applied to the thin film transistors of the display panel 40, so that the thin film transistors can be turned off. The data enable signal (DE signal, also called as effective display data strobe signal) is used to distinguish whether a received video signal is a valid video signal or an invalid video signal.

Figure 4:
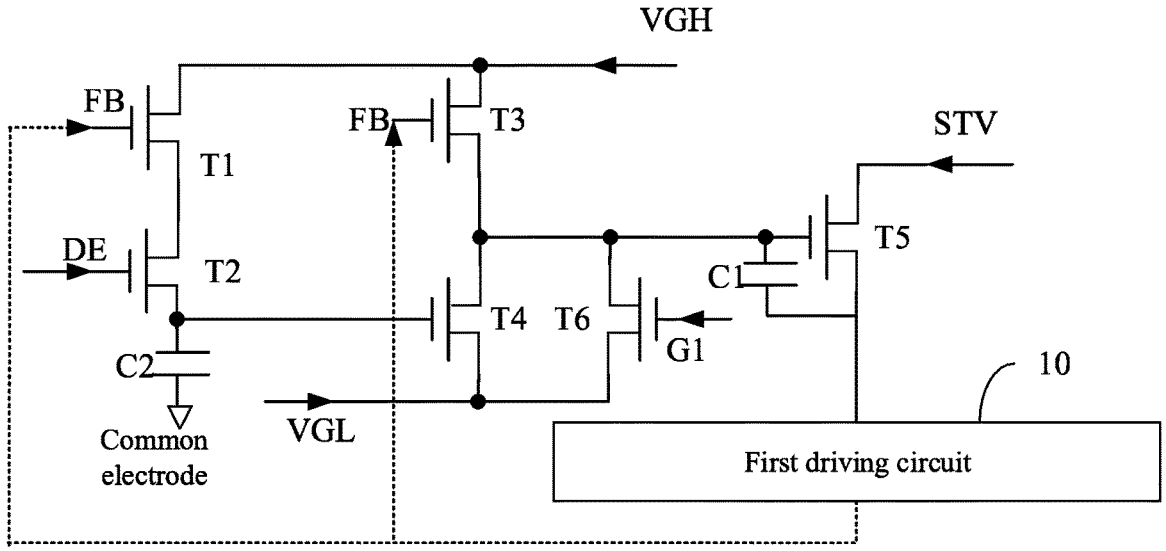
FIG. 4 is schematic diagram illustrating a connection between a first self-test interrupt circuit and a first driving circuit in accordance with one or more embodiments.

In order to better explain a working process of the first driving circuit 10, the timing diagram shown in FIG. 4 is taken as an example, where T1 to T6 are all turned on when the gate is loaded with a high level. At time t1, the data enable signal is a low level, the second transistor T2 and the fourth transistor T4 are turned off. When the signal fed back by the first driving circuit 10 is a normal signal (FB/normal signal), the first transistor T1 and the third transistor T3 are turned on, and the scanning signal G1 is a low level. The sixth transistor T6 is turned off, the gate-on power supply voltage VGH charges the gate of the fifth transistor T5, so that the fifth transistor T5 is turned on, and the vertical synchronizing signal STV is input to the first driving circuit 10. The gate of the fifth transistor T5 maintains a high potential due to voltage regulation of the first capacitor C1. At time t3, when the vertical synchronization signal STV is output at a high level, the first driving circuit 10 is driven to operate, thereby driving the display panel 40 to display normally. After the vertical synchronizing signal STV is output at a high level, that is, at time t4, the scanning signal G1 is input at a high stage, and the sixth transistor T6 is turned on. At this time, the gate of the fifth transistor T5 is at a low potential, and the fifth transistor T5 is turned off to perform a drop-down reset.

At any time, when the signal fed back by the first driving circuit 10 is a DC signal (FB/abnormal1 signal), since the signal fed back by the first driving circuit 10 is at a low level, the first transistor T1 and the third transistor T3 are both turned off. The fifth transistor T5 cannot be turned on, and the vertical synchronizing signal STV cannot be input to the first driving circuit 10. At this time, the first driving circuit 10 cannot normally drive the display panel 40 to display, the display of the display panel 40 is driven by the second driving circuit 20. When the signal fed back by the first driving circuit 10 is a multi-pulse signal (FB/abnormal2 signal), even at time t1, the vertical synchronizing signal STV can be normally input to the first driving circuit 10. After the vertical synchronizing signal STV is output at a high level, the scan signal G1 is input at a high level. The signal (FB/abnormal2 signal) fed back by the first driving circuit 10 and the scan signal G1 are both high levels. At this time, the first transistor T1 and the second transistor T2 are simultaneously turned on, the gate of the fourth transistor T4 stores a high potential, and the fourth transistor T4 remains in a turn-on state, so that the gate of the fifth transistor T5 cannot be driven to a high potential, which causes that the fifth transistor T5 cannot be turned on, and the vertical synchronization signal STV cannot be normally input to the first driving circuit 10. At this time, the display of the display panel 40 is driven by the normally operating second driving circuit 20.

In summary, the first self-test interrupt circuit 31 can automatically interrupt the drive of the display panel 40 by the first driving circuit 10 when the signal fed back by the first driving circuit 10 is a DC signal or a multi-pulse abnormal signal, and the display of the display panel 40 is driven by the normally operating second driving circuit 20, thereby improving drive efficiency and reliability. Optionally, the gate of the first transistor T1 and the gate of the third transistor T3 can be connected to the last level output terminal of the first driving circuit 10. In one of the embodiments, the first self-test interrupt circuit further includes a second capacitor C2, which is connected in series between the second transistor T2 and the common electrode. The first transistor, the second transistor, the third transistor, the fourth transistor, the fifth transistor, and the sixth transistor can be N-channel field effect transistors, or can be other type transistors, as long as it is a transistor meeting the above working logic, it falls within the scope of this application.

Figure 5:
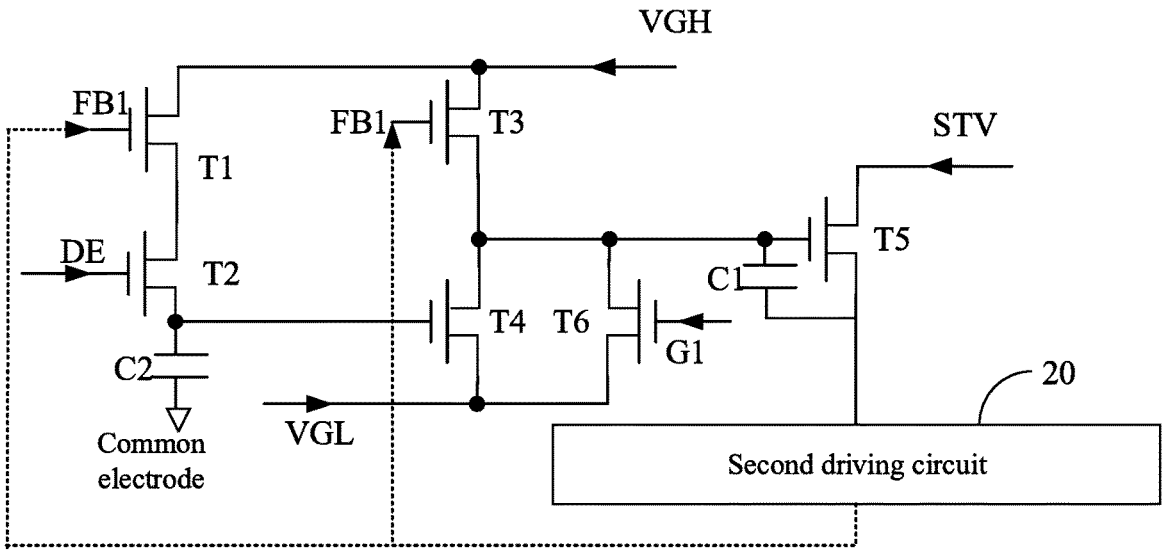
FIG. 5 is schematic diagram illustrating a connection between a second self-test interrupt circuit and a second driving circuit in accordance with one or more embodiments.

In one of the embodiments, as shown in FIG. 5, the second self-test interrupt circuit 32 has the same structure as the first self-test interrupt circuit 31. The second electrode of the fifth transistor T5 in the second self-test interrupt circuit 32 is connected to the input terminal of the second driving circuit 20. When referring that the second self-test interrupt circuit 32 has the same structure as the first self-test interrupt circuit 31, it refers to that an internal circuit structure of the first self-test interrupt circuit 31 is identical to an internal circuit structure of the second self-test interrupt circuit 32, while an external port of each device varies correspondingly according to the control object of the self-test interrupt. the second electrode of the fifth transistor T5 in the second self-test interrupt circuit 32 is connected to the input terminal of the second driving circuit 20 to control the drive state of the second driving circuit 20. the gate of the first transistor T1 and the gate of the third transistor T3 are both connected to the output terminal of the second driving circuit 20 to collect the feedback signal FB1 of the second driving circuit 20, thereby determining whether the second driving circuit 20 is abnormal. Optionally, the gate of the first transistor T1 and the gate of the third transistor T3 are both connected to the last level output terminal of the second driving circuit 20. Optionally, the second self-test interrupt circuit further includes a second capacitor C2 connected in series between the second transistor T2 and the common electrode.

A display is further provided in an embodiment of the present disclosure. As shown in FIGS. 1 and 2, the display includes a display panel 40 and the forgoing display control device. According to the display provided herein, when the first driving circuit 10 and the second driving circuit 20 are both normal, the display of the display panel 40 are driven by the first driving circuit 10 and the second driving circuit 20 respectively from the second side and the second side. When the self-test interrupt module 30 determines that the first driving circuit 10 is abnormal according to the acquired signal fed back by the first driving circuit 10, the input path of the vertical synchronization signal to the first driving circuit 10 is cut off, so that the first driving circuit 10 cannot perform the drive operation and the display of the display panel 40 is unilaterally driven by the second driving circuit 20. Similarly, if the self-test interrupt module 30 determines that the second driving circuit 20 is abnormal according to the acquired signal fed back by the second driving circuit 20, the input path of the vertical synchronization signal to the second driving circuit 20 is cut off, so that the second driving circuit 20 cannot perform the drive operation, and the display panel 40 is unilaterally driven by the first driving circuit 10, thereby improving the driving reliability and effectiveness of the display. In one of the embodiments, the display panel 40 can be a liquid crystal display panel.

Figure 6:
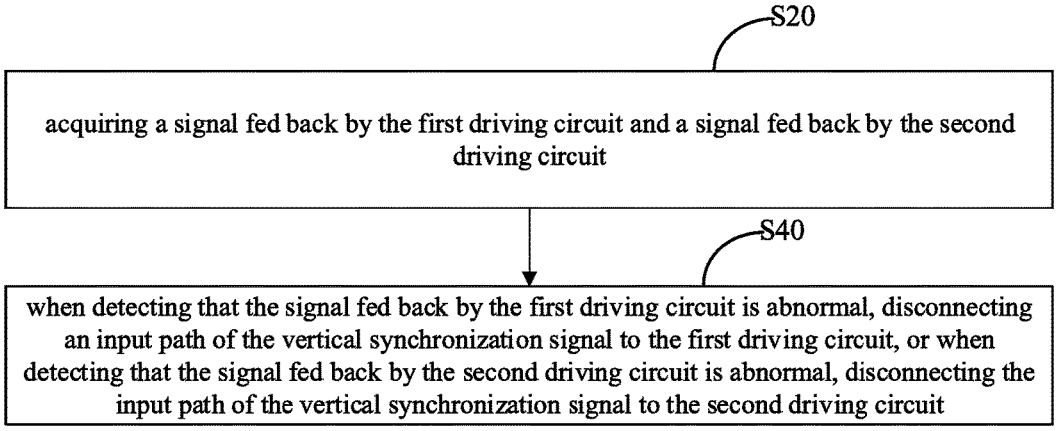
FIG. 6 is a flowchart of a self-test interrupt method in accordance with one or more embodiments.

As shown in FIG. 6, a self-test interrupt method applied to the forgoing display control device is further provided in an embodiment of the present disclosure, which includes the following steps.

In S20, a signal fed back by the first driving circuit and a signal fed back by the second driving circuit are acquired.

In S40, when detecting that the signal fed back by the first driving circuit is abnormal, an input path of a vertical synchronization signal to the first driving circuit is disconnected; or when detecting that the signal fed back by the second driving circuit is abnormal, the input path of the vertical synchronization signal to the second driving circuit is disconnected.

The definitions of the first driving circuit and the like are the same as those in the afore-described embodiments, and the details thereof are not described herein. First, the signal fed back by the first driving circuit and the signal fed back by the second driving circuit are acquired, whether the first driving circuit is faulty or not can be determined by determining that whether the signal fed back by the first driving circuit is abnormal. If the first driving circuit is faulty, the input path of the vertical synchronization signal to the first driving circuit is disconnected, and the display of the display panel is driven by the second driving circuit. Alternatively, when detecting the signal fed back by the second driving circuit is abnormal, the input path of the vertical synchronization signal to the second driving circuit is disconnected, and the display of the display panel is driven by the first driving circuit. The self-test interrupt method provided in the embodiment of the present application determines whether the driving circuits on both sides are faulty by detecting the feedback signals of the driving circuits on both sides. If the driving circuit on one side fails, the drive operation of the driving circuit on a fault side is interrupted. The display of the display panel is driven by the driving circuit on a normal side, and the bilateral drive mode is switched to the unilateral drive mode to ensure that the display of the display panel can be normally driven when one unilateral driving circuit is faulty, thereby improving driving reliability and effectiveness.

Figure 7:
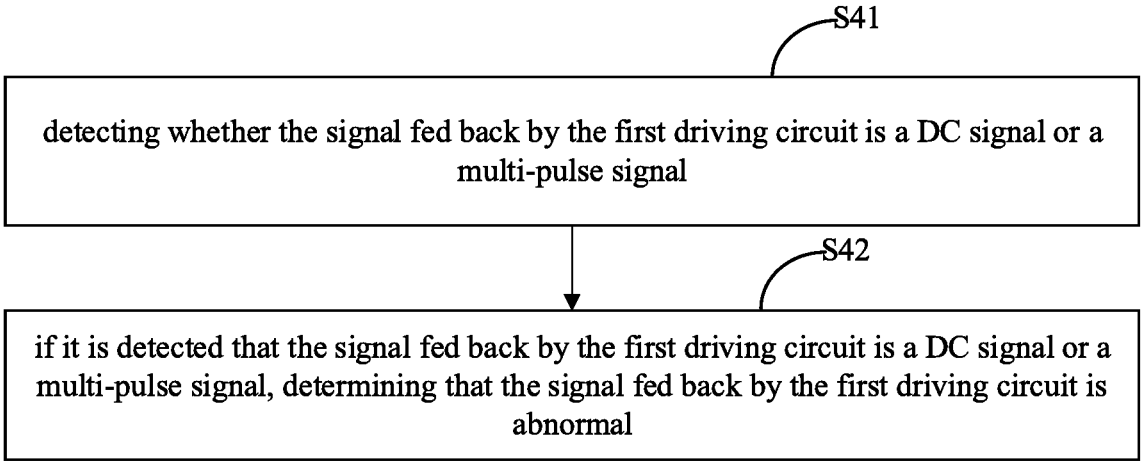
FIG. 7 is a flowchart showing steps of determining that a signal fed back by a first driving circuit is abnormal in accordance with one or more embodiments.

In one of the embodiments, as shown in FIG. 7, the step of detecting whether the signal fed back by the first driving circuit is abnormal includes following steps.

In S41, whether the signal fed back by the first driving circuit is a DC signal or a multi-pulse signal is detected.

In S42, if it is detected that the signal fed back by the first driving circuit is a DC signal or a multi-pulse signal, it is determined that the signal fed back by the first driving circuit is abnormal.

In engineering practice, there are two common types of abnormalities of the first driving circuit. A first type is that the signal fed back by the first driving circuit is a direct current potential, that is, the drive signal cannot be normally transmitted through the first driving circuit. A second type is that an output portion of the first driving circuit is abnormal, and the feedback signal of the first driving circuit at this time is consistent with the timing thereof, and is a multi-pulse signal. Therefore, the step of detecting whether the signal fed back by the first driving circuit is abnormal can be that detecting whether the signal fed back by the first driving circuit is a DC signal or a multi-pulse signal, if the signal fed back by the first driving circuit is one of two signals, it is determined that the signal fed back by the first driving circuit is abnormal.

Figure 8:
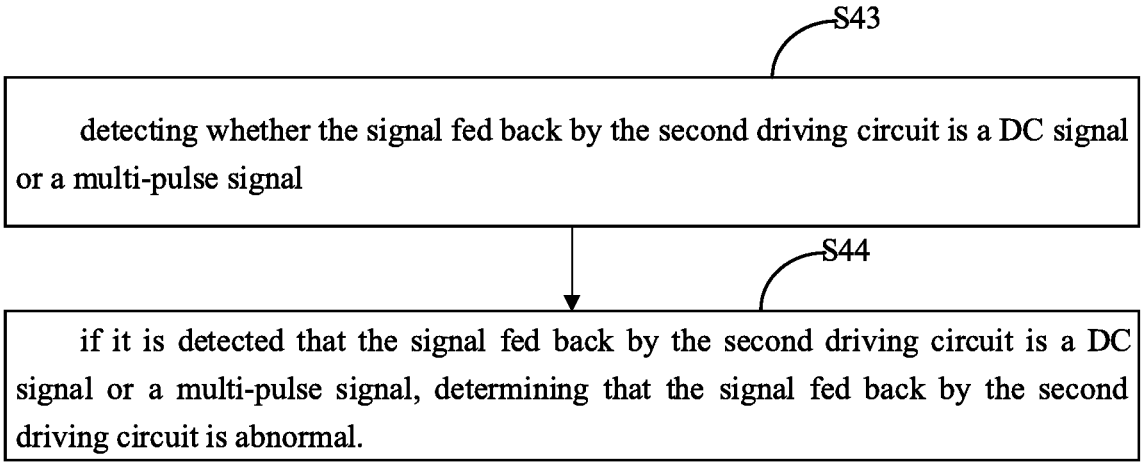
FIG. 8 is a flowchart showing steps of determining that a signal fed back by a second driving circuit is abnormal in accordance with one or more embodiments.

In one of the embodiments, as shown in FIG. 8, the step of detecting whether the signal fed back by the second driving circuit is abnormal includes following steps.

In S43, whether the signal fed back by the second driving circuit is a DC signal or a multi-pulse signal is detected.

In S44, if it is detected that the signal fed back by the second driving circuit is a DC signal or a multi-pulse signal, it is determined that the signal fed back by the second driving circuit is abnormal.

Similar to the determination process of whether the signal fed back by the first driving circuit is abnormal, the steps of determining whether the signal fed back by the second driving circuit is abnormal can be that detecting whether the signal fed back by the second driving circuit is a DC signal or a multi-pulse signal, if the signal fed back by the second driving circuit is one of two signals, it is determined that the signal fed back by the second driving circuit is abnormal.

It should be understood that, although the steps in the flowcharts of FIG. 6 to FIG. 8 are sequentially displayed as indicated by arrows, these steps are not necessarily performed in an order indicated by the arrows. Unless otherwise explicitly stated in this specification, these steps are not performed in a strictly limited order, and the steps can be performed in other orders. In addition, at least some of the steps in FIG. 6 to FIG. 8 can include multiple sub-steps or multiple stages. These sub-steps or stages are not necessarily performed at a same moment, but can be performed at different moments. These sub-steps or stages are not necessarily performed sequentially, but can be performed by turns or alternately with other steps or at least some sub-steps or stages of other steps.

Figure 9:
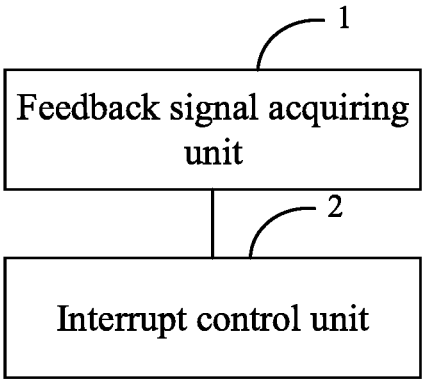
FIG. 9 is a schematic diagram of a self-test interrupt device in accordance with one or more embodiments.

A self-test interrupt device is further provided in one embodiment of the present application. As shown in FIG. 9, the self-test interrupt device includes:

a feedback signal acquiring unit 1 configured to acquire a signal fed back by the first driving circuit and a signal fed back by the second driving circuit;

a interrupt control unit 2 configured to disconnect an input path of a vertical synchronization signal to the first driving circuit, when detecting that the signal fed back by the first driving circuit is abnormal, or disconnect the input path of the vertical synchronization signal to the second driving circuit, when detecting that the signal fed back by the second driving circuit is abnormal.

The definitions of the first driving circuit and the like are the same as those in the forgoing embodiments, and the details thereof are not described herein. The feedback signal acquiring unit 1 acquires the signal fed back by the first driving circuit and the signal fed back by the second driving circuit, and sends the signal to the interrupt control unit 2, then the interrupt control unit 2 detects whether the signal fed back by the first driving circuit is abnormal, and if the signal fed back by the first driving circuit is determined as abnormal, the input path of the vertical synchronization signal to the first driving circuit is disconnected, or when the signal fed back by the second driving circuit is detected as abnormal, the input path of the vertical synchronization signal to the second driving circuit is disconnected. The self-test interrupt device provided in the embodiment of the present application can automatically switch from the bilateral drive mode to the unilateral drive mode when one unilateral driving circuit is faulty, thereby improving the reliability and yield of the display drive of the display panel.

For the specific definition of the self-test interrupt device, reference can be made to the above description of the self-test interrupt method, and details are not described herein again. The various modules in the afore-described self-test interrupt device can be implemented in whole or in part by software, hardware, and combinations thereof. Each of the above modules can be embedded in or independent from the processor in the computer device in a hardware form, or can be stored in a memory in the computer device in a software form, so that the processor invokes the operations corresponding to the above modules.

Figure 10:
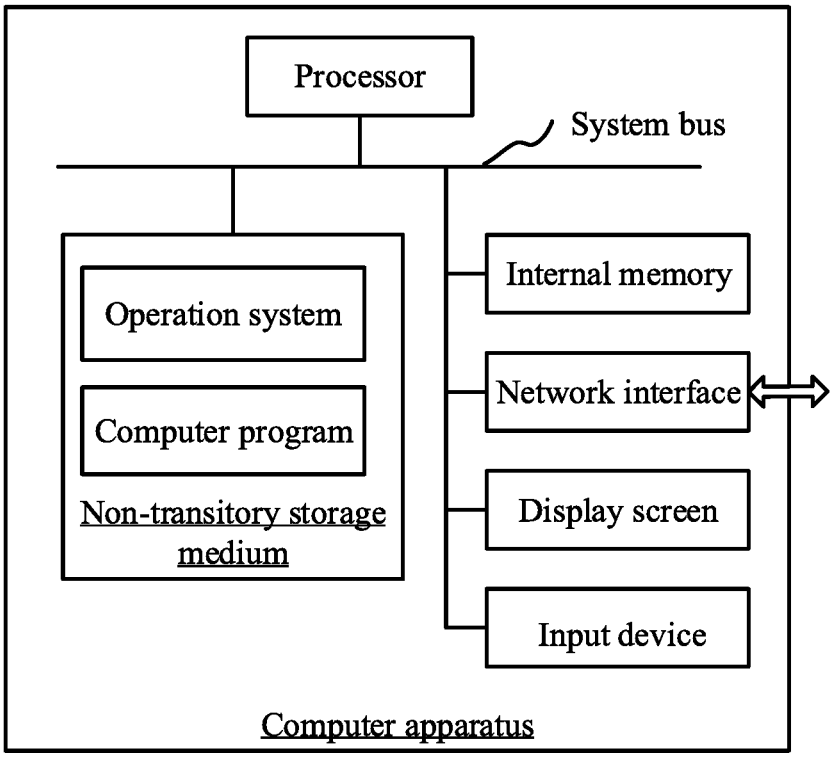
FIG. 10 is block diagram of a computer apparatus in accordance with one or more embodiments.

In one embodiment, a computer device is provided, which can be an interrupter, an internal structure of which can be as shown in FIG. 10. The computer device includes a processor, a memory, a network interface, a display panel, and an input device connected by a system bus. The processor of the computer device is used to provide computing and control capabilities. The memory of the computer device includes a non-transitory storage medium, an internal memory. The non-transitory storage medium stores an operating system and a computer program. The internal memory provides an environment for operation of the operating system and the computer program in the non-transitory storage medium. The network interface of the computer device is used to communicate with an external interrupter via a network connection. The computer program is executed by the processor to implement a self-test interrupt method. The display panel of the computer device can be a liquid crystal display panel or an electronic ink display panel. The input device of the computer device can be a touch layer covered on the display screen, or can be a button, a trackball or a touchpad provided on the computer device casing. It can also be an external keyboard, trackpad or mouse.

It should be understood by those skilled in the art that the structure shown in FIG. 10 is merely a block diagram of a part of the structure related to the solution of the present application, and does not constitute a limitation of the computer device to which the solution of the present application is applied. The computer device can include more or fewer components than those shown in the figures, or combine some components, or have different component arrangements.

A computer device includes a processor and a memory storing a computer program, which, when executed by the processor implements the steps shown in FIG. 6.

In S20, a signal fed back by the first driving circuit and a signal fed back by the second driving circuit is acquired.

In S40, when detecting that the signal fed back by the first driving circuit is abnormal, an input path of a vertical synchronization signal to the first driving circuit is disconnected, or when detecting that the signal fed back by the second driving circuit is abnormal, the input path of the vertical synchronization signal to the second driving circuit is disconnected.

In the computer device provided in the present application, the processor thereof, when in operation, can retrieve the computer program stored in the memory, and during the execution of the program, an abnormality detection of the first driving circuit and the second driving circuit can be implemented, the drive of the driving circuit on the abnormal side can be automatically interrupted according to the detection result, and the display of the display panel can be driven by the driving circuit on the normal side, thereby improving the reliability and effectiveness of the drive.

A computer readable storage medium stores a computer program thereon, which, when executed by a processor, implements the steps shown in FIG. 6.

In S20, a signal fed back by the first driving circuit and a signal fed back by the second driving circuit is acquired.

In S40, when detecting that the signal fed back by the first driving circuit is abnormal, an input path of a vertical synchronization signal to the first driving circuit is disconnect, or when detecting that the signal fed back by the second driving circuit is abnormal, the input path of the vertical synchronization signal to the second driving circuit. is disconnected.

A person of ordinary skill in the art can understand that all or some of the procedures of the methods in the foregoing embodiments can be implemented by a computer-readable instruction instructing relevant hardware. The computer-readable instruction can be stored in a non-transitory computer-readable storage medium. When the computer-readable instruction is executed, the procedures of the foregoing method embodiments can be performed. Any reference to a memory, storage, database, or other mediums used in the embodiments provided in this application can include a non-transitory and/or transitory memory. A non-transitory memory can include a read-only memory (ROM), a programmable ROM (PROM), an electrically programmable ROM (EPROM), an electrically erasable programmable ROM (EEPROM), a flash memory, or the like. The transitory memory can include a random access memory (RAM) or an external high-speed cache. By way of illustration and not limitation, the RAM is available in various forms, such as a static RAM (SRAM), a dynamic RAM (DRAM), a synchronous DRAM (SDRAM), a double data rate SDRAM (DDRSDRAM), an enhanced SDRAM (ESDRAM), a synchronization link (Synchlink) DRAM (SLDRAM), a rambus (Rambus) direct RAM (RDRAM), a direct rambus dynamic RAM (DRDRAM), and a rambus dynamic RAM (RDRAM). The technical features of the above-described embodiments may be combined in any combination. For the sake of brevity of description, all possible combinations of the technical features in the above embodiments are not described. However, as long as there is no contradiction between the combinations of these technical features, All should be considered as the scope of this manual.

Various technical features in the foregoing embodiments can be combined randomly. For ease of description, possible combinations of various technical features in the foregoing embodiments are not all described. However, the combinations of the technical features should be considered as falling within the scope recorded in this specification provided that the combinations of the technical features are compatible with each other.

The foregoing embodiments show only several implementations of this application and are described in detail, but they should not be construed as a limitation on the patent scope of this application. It should be noted that various changes and improvements can further be made by a person of ordinary skill in the art without departing from the idea of this application, and these changes and improvements all fall within the protection scope of this application. Therefore, the protection scope of the patent of this application shall be subject to the appended claims.

What is claimed is:

1. A display control device, comprising:

a first driving circuit having a first driving circuit input terminal and a first driving circuit multi-stage output terminal and is adapted to drive a display panel from a first side, wherein the display panel includes a positive power input terminal adapted to connect to a gate-on power supply, a negative power input terminal adapted to connect to a gate-off power supply, and a common electrode adapted to access a common voltage;

a second driving circuit having a second driving circuit input terminal and a second driving circuit multi-stage output terminal and adapted to drive the display panel from a second side, and a self-test interrupt module including a first self-test interrupt circuit and a second self-test interrupt circuit, wherein the first self-test interrupt circuit includes first, second, third, fourth, fifth and sixth transistors, and a first capacitor, and wherein a first electrode of the first transistor is adapted to connect to the positive power input terminal, a control electrode of the first transistor is adapted to connect to the first driving circuit output terminal, and a second electrode of the first transistor is adapted to connect to a first electrode of the second transistor;

wherein a first self-test interrupt circuit input terminal is connected to a first driving circuit rear stage output terminal, and a first self-test interrupt circuit output terminal is connected to the first driving circuit input terminal, wherein a second self-test interrupt circuit input terminal is connected to a second driving circuit rear stage output terminal, and a second self-test interrupt circuit output terminal is connected to the second driving circuit input terminal, wherein a start signal terminal of the self-test interrupt module is configured to access a vertical synchronization signal, wherein a second control electrode of the second transistor is adapted to access a data enable signal, a second electrode of the second transistor is adapted to connect to the common electrode and to a control electrode of the fourth transistor, wherein a first electrode of the third transistor is adapted to connect to the positive power input terminal, a control electrode of the third transistor is connected to the first driving circuit output terminal, a second electrode of the third transistor is respectively connected to a first electrode of the fourth transistor, a control electrode of the fifth transistor, and a first electrode of the sixth transistor, wherein a second electrode of the fourth transistor is adapted to connect to the negative power input terminal, wherein a first electrode of the fifth transistor is adapted to access the vertical synchronization signal, and a second electrode of the fifth transistor is connected to the first driving circuit input terminal, wherein a control electrode of the sixth transistor is adapted to access a scan signal, and the scan signal is adapted to perform line scan on the display panel, wherein a second electrode of the sixth transistor is configured to be connected to the negative power input terminal, a first end of the first capacitor is connected to the control electrode of the fifth transistor, and a second end of the first capacitor is connected to the second electrode of the fifth transistor, and wherein the self-test interrupt module is configured to disconnect an input path of the vertical synchronization signal to the first driving circuit when a first signal fed back from the first driving circuit output terminal is abnormal, or the self-test interrupt module is configured to disconnect the input path of the vertical synchronization signal to the second driving circuit when a second signal fed back from the second circuit output terminal is abnormal.

2. The device according to claim 1, wherein the first self-test interrupt circuit further includes a second capacitor, wherein a first end of the second capacitor is connected to the second electrode of the second transistor, and a second end of the second capacitor is connected to a common voltage input terminal.

3. The device according to claim 1, wherein the second self-test interrupt circuit includes a same circuit as the first self-test interrupt circuit, and wherein a second electrode of a fifth transistor of the second self-test interrupt circuit is connected to the second driving circuit input terminal, and wherein a first transistor gate and a third transistor gate in the second self-test interrupt circuit are both connected to the second driving circuit output terminal.

4. The device according to claim 2, wherein the second self-test interrupt circuit includes a same circuit as the first self-test interrupt circuit, and wherein a fifth transistor second electrode of the second self-test interrupt circuit is connected to the second driving circuit input terminal, and wherein a first transistor gate and a third transistor gate in the second self-test interrupt circuit are both connected to the second driving circuit output terminal.

5. The device according to claim 1, wherein the first transistor, the second transistor, the third transistor, the fourth transistor, the fifth transistor, and the sixth transistor are N-channel field-effect transistors.

6. A display, comprising:

a display panel, and a device, the device including:

a first driving circuit adapted to drive the display panel from a first side and including a first driving circuit input terminal and a first driving circuit multi-stage output terminal;

a second driving circuit adapted to drive the display panel from a second side and including a second driving circuit input terminal and a second driving circuit multi-stage output terminal; and a self-test interrupt module having a first self-test interrupt circuit, a second self-test interrupt circuit, first, second, third, fourth, fifth, and sixth transistors, and a first capacitor, wherein a first self-test interrupt circuit input terminal is connected to a first driving circuit rear stage output terminal, and a first self-test interrupt circuit output terminal is connected to the first driving circuit, wherein a second self-test interrupt circuit input terminal is connected to a second driving circuit rear stage output terminal, and a second self-test interrupt circuit output terminal is connected to the second driving circuit input terminal, wherein a start signal terminal of the self-test interrupt module is configured to access a vertical synchronization signal, wherein a control electrode of the second transistor is adapted to access a data enable signal, a second electrode of the second transistor is adapted to connect to the common electrode and to a control electrode of the fourth transistor, wherein a first electrode of the third transistor is adapted to connect to the positive power input terminal, a control electrode of the third transistor is connected to the first driving circuit output terminal, a second electrode of the third transistor is respectively connected to a first electrode of the fourth transistor, a control electrode of the fifth transistor, and a first electrode of the sixth transistor, wherein a second electrode of the fourth transistor is adapted to connect to the negative power input terminal, wherein a first electrode of the fifth transistor is adapted to access the vertical synchronization signal, and a second electrode of the fifth transistor is connected to the first driving circuit input terminal, wherein a control electrode of the sixth transistor is adapted to access a scan signal, and the scan signal is adapted to perform line scan on the display panel, wherein a second electrode of the sixth transistor is configured to be connected to the negative power input terminal, a first end of the first capacitor is connected to the control electrode of the fifth transistor, and a second end of the first capacitor is connected to the second electrode of the fifth transistor, and wherein the self-test interrupt module is adapted to disconnect an input path of the vertical synchronization signal to the first driving circuit when a first signal fed back by the first driving circuit is abnormal, or disconnect the input path of the vertical synchronization signal to the second driving circuit when a second signal fed back by the second driving circuit is abnormal.

7. The display according to claim 6, wherein the first self-test interrupt circuit further includes a second capacitor having first and second ends, wherein the first end of the second capacitor is connected to the second electrode of the second transistor, and the second end of the second capacitor is connected to a common voltage input terminal.

8. The display according to claim 6, wherein the second self-test interrupt circuit includes a same circuit as the first self-test interrupt circuit, and wherein a second electrode of the fifth transistor of the second self-test interrupt circuit is connected to the second driving circuit input terminal, and wherein a first transistor gate and a third transistor gate in the second self-test interrupt circuit are both connected to the second driving circuit output terminal.

9. The display according to claim 7, wherein the second self-test interrupt circuit comprises the same circuit as the first self-test interrupt circuit, and a second electrode of the fifth transistor of the second self-test interrupt circuit is connected to the second driving circuit input terminal, a first transistor gate and a third transistor gate in the second self-test interrupt circuit are both connected to the second driving circuit output terminal.

10. The display according to claim 6, wherein the first transistor, the second transistor, the third transistor, the fourth transistor, the fifth transistor, and the sixth transistor are N-channel field effect transistors.

11. The display according to claim 6, wherein the display panel is a liquid crystal display panel.

12. A self-test interrupt method of a device, the device comprising a first driving circuit having a first driving circuit input terminal and a first driving circuit multi-stage output terminal and adapted to drive a display panel from a first side, wherein the display panel comprises a positive power input terminal adapted to connect to a gate-on power supply, a negative power input terminal adapted to connect to a gate-off power supply, and a common electrode adapted to access a common voltage, a second driving circuit having a second driving circuit input terminal and a second driving circuit multi-stage output terminal and adapted to drive the display panel from a second side, and a self-test interrupt module including a first self-test interrupt circuit and a second self-test interrupt circuit, wherein the first self-test interrupt circuit includes first, second, third, fourth, fifth, and sixth transistors, and a first capacitor, and wherein a first electrode of the first transistor is adapted to connect to the positive power input terminal, a control electrode of the first transistor is adapted to connect to the first driving circuit output terminal, and a second electrode of the first transistor is adapted to connect to a first electrode of the second transistor; wherein a first self-test interrupt circuit input terminal is connected to a first driving circuit rear stage output terminal, and a first self-test interrupt circuit output terminal is connected to the first driving circuit input terminal, wherein a second self-test interrupt circuit input terminal is connected to a second driving circuit rear stage output terminal, and a second self-test interrupt circuit output terminal is connected to the second driving circuit input terminal, wherein a start signal terminal of the self-test interrupt module is configured to access a vertical synchronization signal wherein a control electrode of the second transistor is adapted to access a data enable signal, a second electrode of the second transistor is adapted to connect to the common electrode and to a control electrode of the fourth transistor, wherein a first electrode of the third transistor is adapted to connect to the positive power input terminal, a control electrode of the third transistor is connected to the first driving circuit output terminal, a second electrode of the third transistor is respectively connected to a first electrode of the fourth transistor, a control electrode of the fifth transistor, and a first electrode of the sixth transistor, wherein a second electrode of the fourth transistor is adapted to connect to the negative power input terminal, wherein a first electrode of the fifth transistor is adapted to access the vertical synchronization signal, and a second electrode of the fifth transistor is connected to the first driving circuit input terminal, wherein a control electrode of the sixth transistor is adapted to access a scan signal, and the scan signal is adapted to perform line scan on the display panel, wherein a second electrode of the sixth transistor is configured to be connected to the negative power input terminal, a first end of the first capacitor is connected to the control electrode of the fifth transistor, and a second end of the first capacitor is connected to the second electrode of the fifth transistor, the self-test interrupt method comprising:

acquiring a first signal fed back by the first driving circuit and a second signal fed back by the second driving circuit; and disconnecting an input path of the vertical synchronization signal to the first driving circuit when the first signal is abnormal, disconnecting the input path of the vertical synchronization signal to the second driving circuit when the second signal is abnormal.

13. The method according to claim 12, further comprising:

detecting whether the first signal fed back by the first driving circuit is a DC signal; and determining that the first signal fed back by the first driving circuit is abnormal if the first signal is a DC signal.

14. The method according to claim 12, further comprising:

detecting whether the first signal fed back by the first driving circuit is a multi-pulse signal; and determining that the first signal fed back by the first driving circuit is abnormal if the first signal is a multi-pulse signal.

15. The method according to claim 12 further comprising:

detecting whether the second signal fed back by the second driving circuit is a DC signal; and determining that the second signal fed back by the second driving circuit is abnormal if the second signal is a DC signal.

16. The method according to claim 12 further comprising:

detecting whether the second signal fed back by the second driving circuit is a multi-pulse signal; and determining that the second signal fed back by the second driving circuit is abnormal if the second signal is a multi-pulse signal.

* * * * *